United States Patent [19]

Goode

[11] Patent Number: 4,637,086

[45] Date of Patent: Jan. 20, 1987

[54] SWIMMING POOL VACUUM CLEANER

[76] Inventor: John Goode, 9767 Commanche Ave., Chatsworth, Calif. 91311

[21] Appl. No.: 690,774

[22] Filed: Jan. 11, 1985

[51] Int. Cl.[4] ..... E04H 3/20

[52] U.S. Cl. ..... 15/1.7; 15/415 R

[58] Field of Search ..... 15/1.7, 415 R, 417

[56] References Cited

U.S. PATENT DOCUMENTS

| | | | |
|---|---|---|---|
| 3,360,816 | 1/1968 | Fontecchio | 15/1.7 |
| 3,805,309 | 4/1974 | Levack | 15/1.7 |
| 4,240,174 | 12/1980 | Thiem et al. | 15/1.7 |

*Primary Examiner*—Edward L. Roberts

*Attorney, Agent, or Firm*—Gilbert Kivenson

[57] ABSTRACT

A swimming pool vacuum cleaning apparatus having a number of pivoted, easily separable sections and provided with end bumpers. The end sections of the apparatus can readily be separated from the center sections by removal of hinge pins. The end sections can then be reversed to place an unworn portion of the bumper in a position exposed to rubbing and the apparatus reassembled. The pivoting feature of the sections allows conformance of the apparatus to uneven bottom surfaces and to the transitional surfaces between the bottom and sides and the bottom and ends of the pool. The apparatus can be conveniently increased in width by the addition of extra center sections and suction openings.

5 Claims, 4 Drawing Figures

SWIMMING POOL VACUUM CLEANER

BACKGROUND OF THE INVENTION

This invention relates to a reversible and expandable head for cleaning the bottom surfaces of swimming pools. It has become standard practice to construct suction heads of relatively soft materials such as plastics to prevent scratching the bottom surfaces and sides of the pool. These soft materials tend to wear rapidly at points of rubbing when used frequently, as in commercial pool cleaning service. It becomes necessary therefore to replace the heads frequently, a costly procedure.

In present day suction sweeping of swimming pools it is desirable for the operator to own several sweepers of different head widths to permit different pool types to be handled efficiently. With a residential pool having limited pump suction, a narrow head should be employed. The increased number of sweeps does not represent excessive labor. A wider head used in this application would give poor suction at its lateral extremes because of the lower flow capacity of a domestic system. In a larger community pool, on the other hand, with a more powerful pumping arrangement, a wider head would be more efficient in terms of the number of sweeps required.

To overcome the fall-off in suction efficiency with width of the sweeping head, a number of schemes have been employed. In one of these, described in U.S. Pat. No. 3,805,309, a series of baffles at the sweeper's lateral ends diverts the incoming flow towards the center and thus towards the suction opening. Pool debris is thus directed to a zone of more powerful suction regardless of the speed with which the operator moves the head. Although this design is effective, it requires an elaborate casting to form the sweeper head.

It is one objective of the present invention to provide a modular suction head in which the portions most subject to wear can easily be reversed for additional service.

It is a second objective of the present invention to provide a modular suction head in which the portions most subject to wear can easily be replaced.

It is a third objective of the present invention to provide a readily modifiable suction head whose width can be altered.

It is a fourth objective of the present invention, in another embodiment, to provide means by which the suction can be maintained over an increased range of widths without an elaborate casting.

DESCRIPTION OF THE INVENTION

Figure 1:
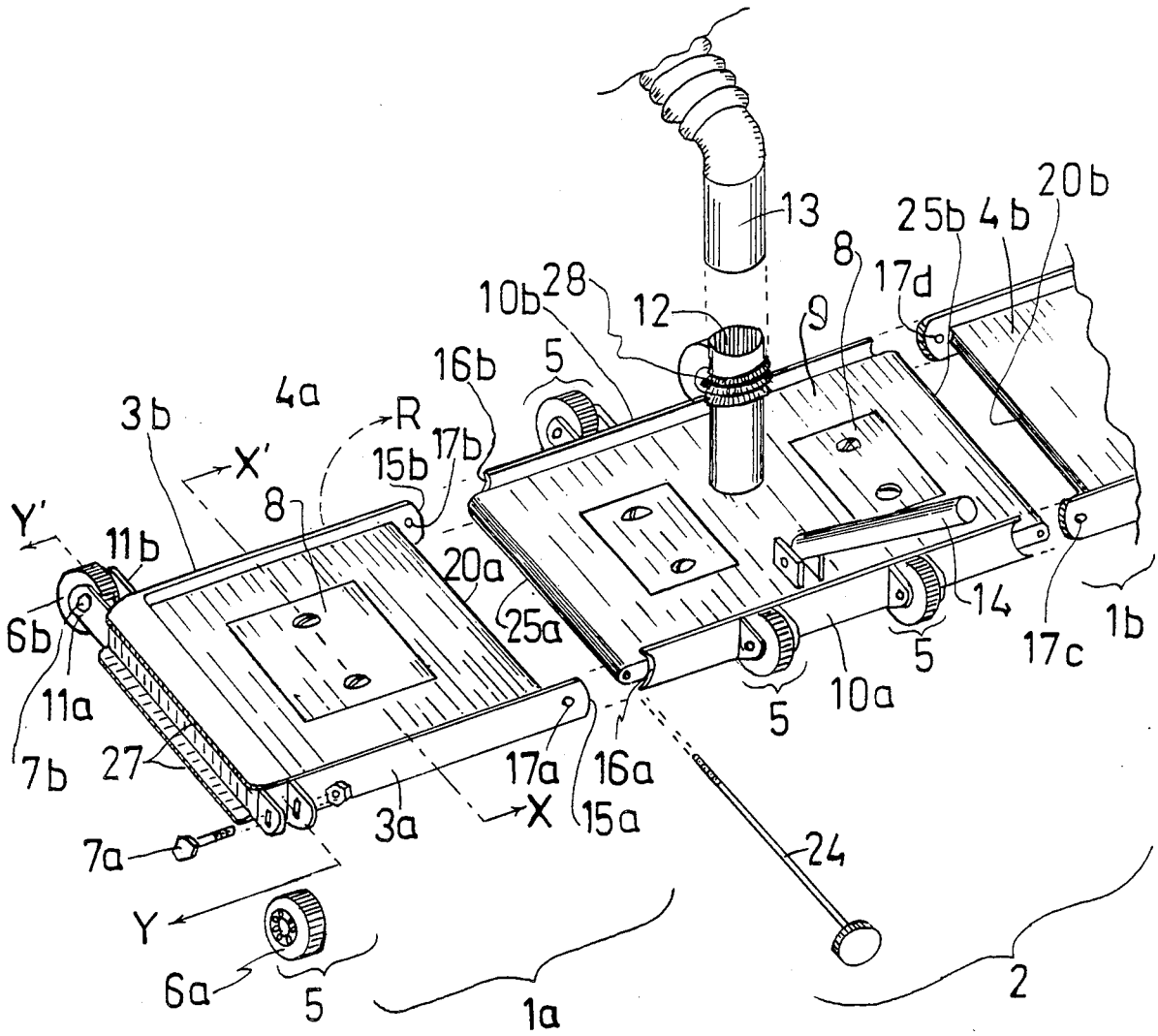
FIG. 1 is an isometric view of one embodiment of the invention showing two modular assemblies and a portion of the third modular assembly, provisions for attaching a suction hose and means for pushing the invention along the bottom of a pool.

The invention in the embodiment shown in FIG. 1, is an assembly of two end modules 1*a* and 1*b* and a center module 2. The left end module embodies a platform section 4*a*, the front and back boffles 3*a* and 3*b* and the wheel assemblies 5. Each wheel assembly is made up of the holding plates 11*a* and 11*b*, the ball bearing equipped wheels 6*a* and 6*b*, the wheel holding means 7*a* and 7*b* and the weight 8. The center module 2 includes the weighted platform section 9, the front and back boffles 10*a* and 10*b*, the four wheel assemblies 5 and the suction duct 12. The latter is coupled by molded threads 28 to the flexible hose end piece 13. This connects to the suction side of the pool pump. A push pole 14 is pivotally attached to the platform section 9 and extends beyond the water surface of the pool to permit the operator to propel the sweeper along the bottom as is known to the art.

The boffles 3*a* and 3*b* are curved convexly at their ends 15*a* and 15*b* to provide close engagement with the concave ends 16*a* and 16*b* of the boffles 10*a* and 10*b* respectively. The holes 17*a*,17*b*,17*c*,17*d* and 18 permit the pivotal coupling of the two end modules with the center module by means of pins 24. Holes 17*b* and 17*d* are threaded to mate with threaded portions of the pins. The hinge assembly thus formed imparts flexibility between modules and facilitates conformance with curved pool bottoms. The bumpers 27, attached to each end module absorbs rubbing wear against the sides of the pool. Because most pools have rounded edges where bottom and sides meet, the lower bumpers wear first but can be replaced by the upper ones when the end modules are turned over.

Figure 2:
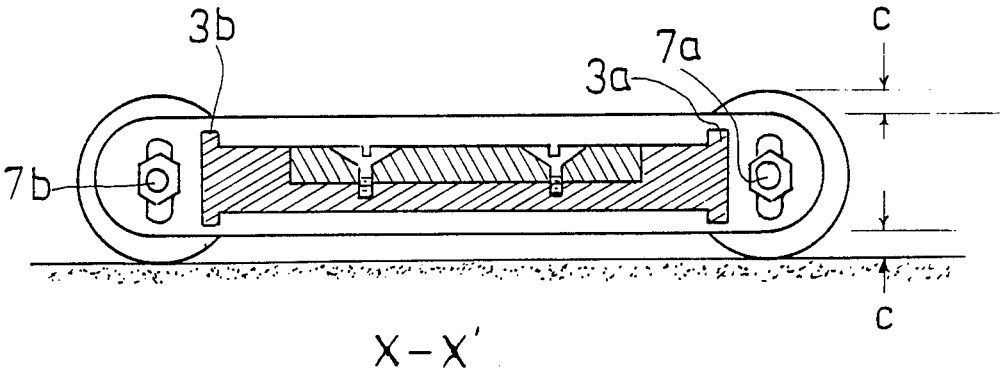
FIG. 2 is a section of the invention as shown in FIG. 1 taken along the line X—X'.
Figure 3:
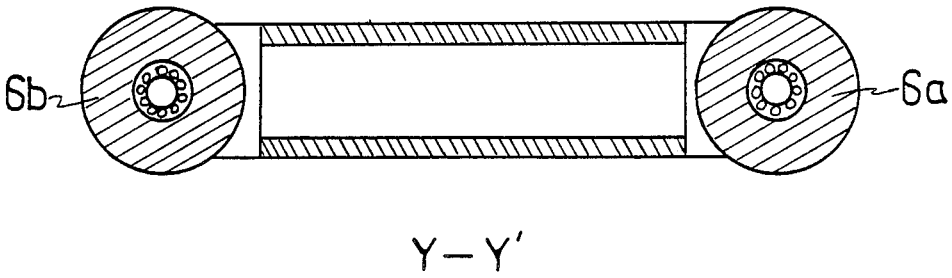
FIG. 3 is a cross section of the invention as shown in FIG. 1 taken along the line Y—Y'.

The flow of water towards the duct 12, induced both by the suction and the movement of the sweeper along the bottom, is constricted by the low clearance of the boffles (C in FIG. 2). This constriction increases the flow velocity and thus keeps water-borne debris in suspension. In time the boffles in the end modules will wear because of rubbing on the uneven bottoms of swimming pools. This results in decreased constriction, lower flow velocities and the settling of the solid material before it reaches the suction line of the sweeper. In previously used pool sweepers it has been necessary to replace the entire suction head when this wear occurred. With the present invention it is only required that the operator remove pin 24 in each end module (FIG. 1), rotate the end modules 1*a* and 1*b* in the direction R and reinsert the pins. The geometric similarity of the upper and lower faces of the end modules allows operation in either orientation and permits doubling of the service life. Boffles 10*a* and 10*b* in the center module are not subject to rubbing and will not wear appreciably. The slots 26, in conjunction with the wheel holding means 7, are useful for fine adjustment of the clearance of the end modules from the bottom.

The platforms 4*a* and 4*b* are made concave at their ends (20*a* and 20*b* in FIG. 1). The center module is rounded convexly at 25*a* and 25*b*. This provides a close fit between modules. In use the sweeper will consequently have little back leakage from the top surface into the lower clearance space.

Figure 4:
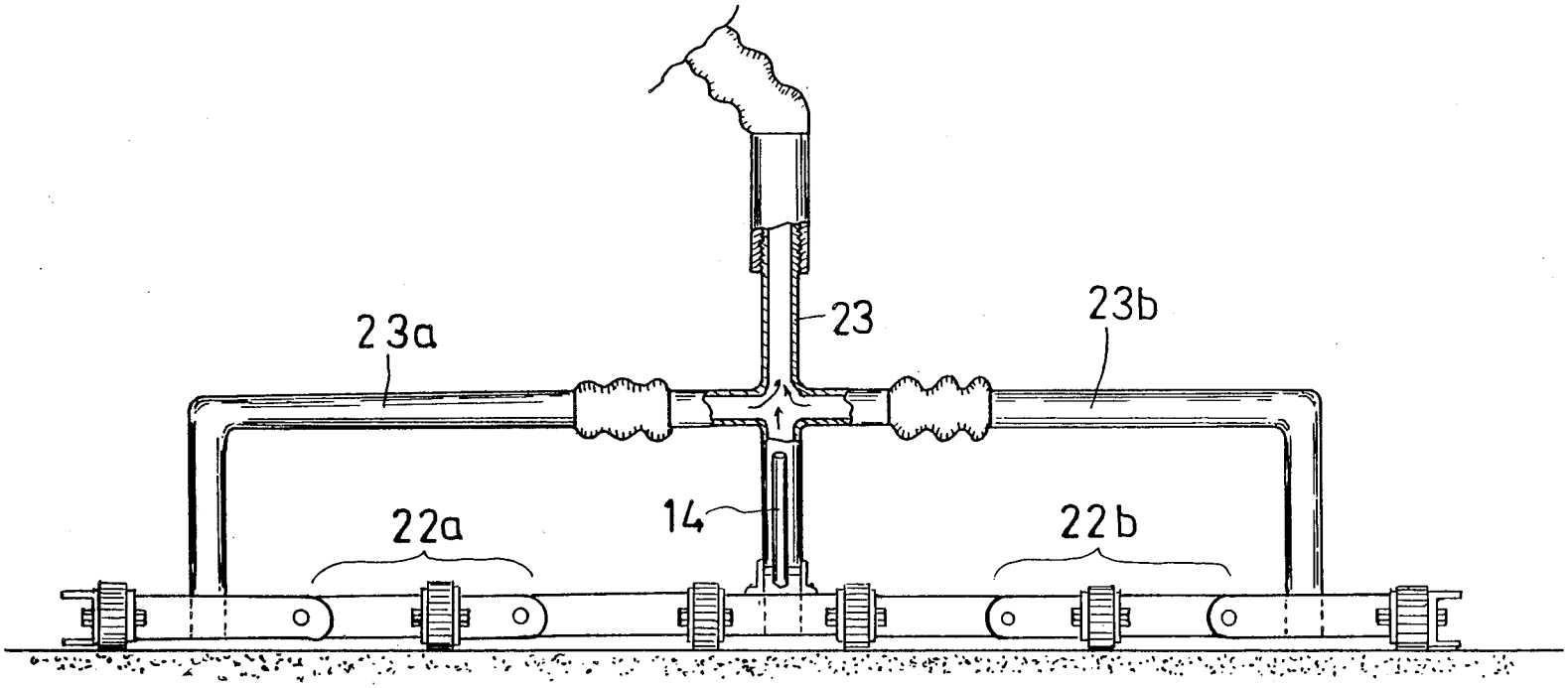
FIG. 4 is a side view of a second embodiment of the invention.

The module concept can also be employed for increasing the width of the sweeper for use in large pools. This involves the adding of two width-increasing modules 22*a* and 22*b* as is shown in FIG. 4. To extend the suction to the extreme ends of the sweeper, extensions 23*a* and 23*b* are attached to the central duct 12 as is shown.

I claim:

1. A moveable suction head assembly for sweeping swimming pool bottoms comprising:

A. a weighted rectangular central platform, horizontally oriented, incorporating a plurality of rollers so as to form a clearance between the lower surface of said central platform and the pool bottom, the rollers permitting straight line travel;

B. a vertical opening communicating with said clearance with provision at its top end for attachment to a vacuum disposal system;

C. a pivoted push rod mounted on the top surface of the central platform by which it can be propelled from above the surface of the pool;

D. low leakage coupling components mounted on those borders of said central platform which are parallel to the direction of travel and constitute its sides;

E. baffles mounted on those borders of said central platform which are perpendicular to the direction of travel and constitute the leading and trailing edges of the central platform, said baffles extending vertically an equal distance above and below the central platform;

F. two weighted rectangular end platforms each incorporating i. a plurality of rollers permitting straight line travel and forming a clearance with the bottom of a swimming pool;

ii. low leakage coupling components on one of the borders of the end platform which is parallel to its direction of travel;

iii. two horizontal bumper strips defining upper and lower strips mounted on the border opposite that holding the low leakage coupling components;

iv. baffles mounted on those borders of said end platform which are perpendicular to its direction of travel and constitute the leading and trailing edges, the baffles extending vertically an equal distance above and below the end platform;

whereby one end platform may be attached to each side of the central platform by said coupling components to make up a suction head assembly of increased width and whereby water flow drawn under all the baffles into the clearances is restricted and thus increases temporarily in velocity, an effect which forms suspensions of solid materials found on the bottom and which facilitates solids removal as the suction sweep head is pushed along the bottom.

2. A moveable suction head assembly as described in claim 1 in which said low leakage coupling means between the central platform and the end platforms are close fitting hinge segments held in place by an easily removeable hinge pin on both sides of the central platform, the assembled hinge segments flexibly joining the central to the end platforms facilitating the movement of the assembly over any uneven bottom surfaces and areas near the walls of swimming pools.

3. A moveable suction head assembly as described in claim 2 in which the use of said close fitting hinge segments and hinge pins minimizes the downward movement of water from the top surfaces of the central and end platforms through the coupling means into the clearances between the bottom surfaces of the assembly and the pool bottom thus increasing the suction efficiency of the vacuum disposal system over the entire width of the assembly.

4. A moveable suction head assembly as described in claims 1 or 2 wherein the bumper strips on each end platform protects against end wear and the position of the bumper strips can be reversed by decoupling each end platform, turning said end platform over and recoupling.

5. A moveable suction head assembly as described in claim 1 in which intermediate rectangular platforms, each having low leakage coupling components on the two borders parallel to its direction of travel, baffles mounted on the two borders perpendicular to its direction of travel and which constitute the leading and trailing edges, the baffle extending vertically an equal distance above and below the intermediate platforms, vacuum openings in each intermediate platform and adapted to be coupled to a vacuum disposal system, and whereby the intermediate platforms can be coupled between the central platform and the end platforms to form a suction head of still further increased width whereby large swimming pools can be conveniently swept.

* * * * *